US007540683B2

(12) United States Patent
Salas

(10) Patent No.: US 7,540,683 B2
(45) Date of Patent: Jun. 2, 2009

(54) SUBTERRANEAN CONDUIT COVER

(76) Inventor: Gary W. Salas, 11031 Hard Rock Rd., Austin, TX (US) 78750

( * ) Notice: Subject to any disclaimer, the term of this patent is extended or adjusted under 35 U.S.C. 154(b) by 0 days.

(21) Appl. No.: 12/074,790

(22) Filed: Mar. 6, 2008

(65) Prior Publication Data

US 2008/0310915 A1 Dec. 18, 2008

Related U.S. Application Data

(63) Continuation-in-part of application No. 11/811,849, filed on Jun. 12, 2007.

(51) Int. Cl.
*E02D 29/14* (2006.01)

(52) U.S. Cl. ..... 404/25; 404/26; 52/19

(58) Field of Classification Search ..... 404/25, 404/26; 137/371; 52/19, 20; 405/40–42
See application file for complete search history.

(56) References Cited

U.S. PATENT DOCUMENTS

| | | | | |
|---|---|---|---|---|
| 2,497,827 | A * | 2/1950 | Trafton | 220/787 |
| 3,674,149 | A * | 7/1972 | Donalson | 210/163 |
| 2007/0164030 | A1 * | 7/2007 | Kearby et al. | 220/300 |

* cited by examiner

*Primary Examiner*—Raymond W Addie
(74) *Attorney, Agent, or Firm*—Chris Whewell

(57) ABSTRACT

Provided herein are covers useful for covering the open end of an access conduit that may contain fluid control equipment. In one embodiment, a cover according to the invention comprises a disc-shaped base portion having a top surface and a bottom surface, with a plurality of groups of stability tangs attached to its bottom surface. A cover as provided herein is readily adaptable to fit a large number of conduit boxes, valve boxes and the like which are presently in common use.

18 Claims, 13 Drawing Sheets

SUBTERRANEAN CONDUIT COVER

CROSS-REFERENCES TO RELATED APPLICATIONS

This application is a Continuation-In-Part of U.S. patent application Ser. No. 11/811,849 filed Jun. 12, 2007 which is currently still pending, the entire contents of which is herein fully incorporated by reference.

TECHNICAL FIELD

This invention relates generally to means for accessing subterranean conduits, which may include plumbing controls. More particularly, it relates to a cover, which is useful for covering conduits.

BACKGROUND

Access conduits are frequently employed, where it is desired to have access to a control device, such as a valve associated with, for example, a sprinkler system in a residential or commercial lawn setting. In such applications, there exists a network of pipes through which water may flow during the normal course of providing irrigating water to such lawns, and often it is convenient for the field technician to have the ability to relieve water pressure from a particular segment of such a sprinkler system. Hence, there are often cases where it is desirous to have a shutoff valve disposed along a distribution line in such a system, in a subterranean location. Accordingly, to protect control equipment such as valves from corrosion or other attack by the elements over time, subterranean conduits have been developed, which are generally enclosures which may be buried in the ground, and within the confines of which a control device such as a valve may be housed to be protected from environmental factors. It is desirable for a field technician to have ready access to such valves, and typically the opening at the terminal end of a tubular access conduit has a flat lid which is placed over it, which may be removed as desired.

SUMMARY OF THE INVENTION

Provided herein are covers useful for covering an open terminal end of an access conduit. In one embodiment such covers include a substantially-circular, disc-shaped base portion having a top surface, a bottom surface, and a circumferential edge, and the base portion is dimensioned to cover the open end. There are a plurality of groups of stability tangs attached to and extending downwardly from the bottom surface of the base portion. The plurality of groups of stability tangs comprises any number of groups of stability tangs between two and twelve, inclusive, wherein each of the groups may comprise any number of individual stability tangs between two and six, inclusive.

DETAILED DESCRIPTION

Figure 1:
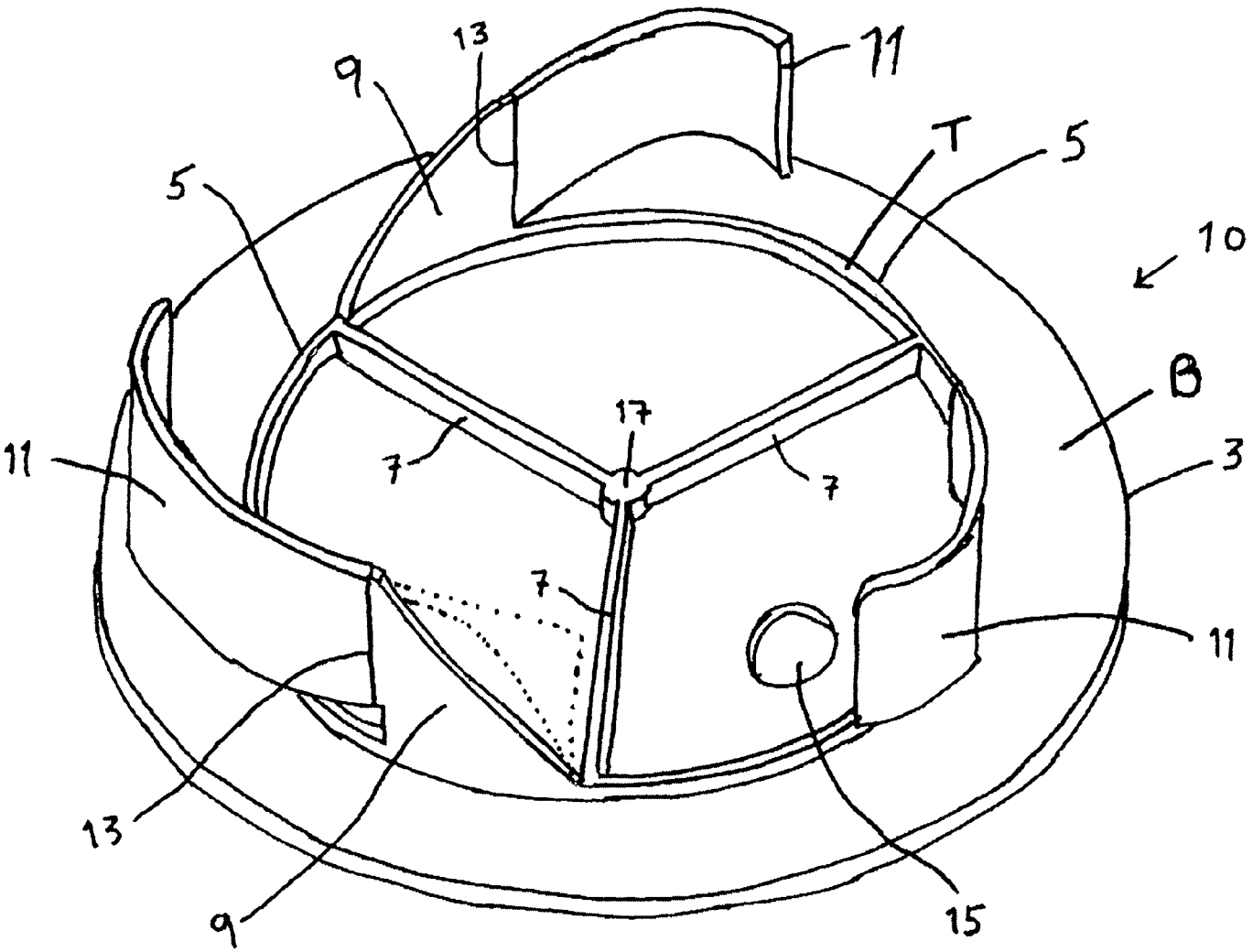
FIG. 1 shows a perspective view of the bottom of a cover according to one embodiment of the invention.

Referring to the drawings, and initially to FIG. 1 there is shown a perspective view of the bottom of a cover 10 according to one embodiment of the invention. In this FIG. 1 there is shown the base portion 3, which exists substantially in the form of a circular disc, having a bottom surface B, which in one preferred form of the invention is flat. Attached to the bottom surface B of the base portion 3 is a circular rib 5, which is disposed to protrude or project upwardly from the bottom surface B. In one embodiment, the circular rib 5 has a rectangular cross section and has a top surface T. In one embodiment, the top surface T is planar and is substantially parallel to the bottom surface B of the base portion 3. In one preferred embodiment, the circular rib 5 is disposed annularly, so as to form a ring, which ring may be located at any point between the center of the base portion 3 and the outer edge of the base portion 3. In a preferred embodiment, the circular rib 5 is disposed to be present on the bottom surface B of the base portion 3 at any location that is distanced between about one-twelfth of the radius of the base portion 3 and three-fourths of the radius of the base portion 3, from the outer circumferential edge of the base portion 3. For example, in one embodiment, when the base portion 3 has a radius of 10 centimeters, the circular rib 5 may be disposed at any location that is between about ten-twelfths ($^{10}/_{12}$) centimeters from the outer circumferential edge of the base portion 3, and 7.5 centimeters from the outer circumferential edge of the base portion 3. In one preferred embodiment, the base portion 3 has a radius of 10 centimeters, and the circular rib 5 is disposed at a location that is about 3 centimeters from the outer edge of the base portion. The location of the circular rib 5 from the circumferential edge of the base portion may be measured from any point on the top surface T of the circular rib, including the inner edge, outer edge, or any point therebetween. In one embodiment, the circular rib 5 has a width dimension of between two millimeters and four centimeters, as viewed from its cross-section. This width dimension is also the width of the top surface T of the circular rib 5, when its cross section is rectangular, as in one embodiment. In one embodiment, the width of the circular rib is between about two millimeters and ten millimeters wide. In a preferred embodiment, the circular rib 5 has a width dimension of about four millimeters, as viewed from its cross-section, corresponding to the width of its top surface T and the cross section is rectangular, the circular rib being disposed so that the midpoint of the width dimension of the circular rib 5 is distanced at a point about three centimeters from the outer circumferential edge of the base portion 3.

Disposed at the top surface T of the circular rib 5, and equally spaced thereabout, with regards to one another along the circular rib 5, are a plurality of risers 9. In one embodiment, the risers 9 extend upwardly, and in a direction that is away from the bottom surface B of the base portion 3, and can also be viewed as protruding upwardly from the circular rib 5, as shown in FIG. 1. The risers 9 are contoured to have a curvature, which substantially matches, and in one embodiment has congruent curvature with the circular rib 5, which embodiment having such congruent curvature can be seen readily from the bottom view in FIG. 2. In one embodiment, the risers 9 are each substantially triangular as viewed from a side perspective, with one of the legs of these triangles so defined being attached to and co-extensive with a segment of the circular rib 5, with the remaining leg of these triangles comprising intersections 13, each of which intersections 13 having attached thereto a contact shoe 11. The intersections 13 in one embodiment permit some movement of each of the contact shoes 13 independently from the relatively stationary position of the risers 9. In one embodiment, this is accomplished by having the thickness of the material from which a cover 10 is comprised being made thinner at the intersections 13 than either on the risers 9 or contact shoes 11. Alternatively, the intersections 13 may be scored, as one scores glass. In yet another alternative embodiment, the cover 10 is polypropylene and the intersections 13 are polypropylene hinges, as such are well known in the art of molded polypropylene articles.

FIG. 1 also shows a plurality of rib segments 7, extending from separate points on the inner wall of the circular rib 9 to a common center hub 17 at which the rib segments intersect, the center hub 17 being shaped in one embodiment in the form of a cylinder and also being disposed on the bottom surface B of the base portion 3. These rib segments 7 may in one embodiment be analogous and identical to the circular rib in construction and cross-section, differing therefrom only in that they are linear, and are not annularly disposed on the bottom surface B of the base portion 3, but rather are disposed in the interior space defined by the circular rib 5, as shown. The rib segments 7 and center hub 17 provide added strength to the cover 10. There is also a hole 15, disposed through the base portion 3, which enables a user to lift the cover from an installed position by inserting their finger through the hole and pulling the cover upwards.

The dotted lines in FIG. 1 show shapes of the risers 9 according to alternate embodiments, when the risers 9 are viewed from the side perspective, including risers having rectangular and smooth curved surfaces, in addition to embodiments in which the risers 9 appear substantially-triangular as viewed from the side, as described below.

A cover 10 according to the invention is preferably comprised of a material having a reasonable strength, and suitable materials include stainless steel, steel, aluminum, any metallic alloys, polymers, polyethylene, polypropylene, alpha olefin copolymers, thermoset resins, thermoplastic vulcanizates, fiberglass, wood, composites, pressed wood fiber composites, etc. It is especially preferred that a device according to the invention be fabricated from an injection-grade polypropylene, based on its strength and durability. However, any material having strength sufficient to support about 150 pounds without undergoing substantial deformation or fracture when installed at the terminal end of a conduit, pipe, valve box or like enclosure (hereinafter simply, "conduit") at ground level is suitable for use in providing a cover 10 according to the invention. When polyolefins, other thermoplastics, and other materials are employed as the material of construction, it is relatively simple to provide a cover 10 according to one or more embodiments, in which a cover 10 as shown in FIG. 1 is made of unitary construction (or "one-piece" construction), that is—wherein all elements described above are present on a single injection molded piece. Thus, the cover 10 shown in FIG. 1, and in other embodiments within the teachings of this disclosure, is a single molded article.

Figure 2:
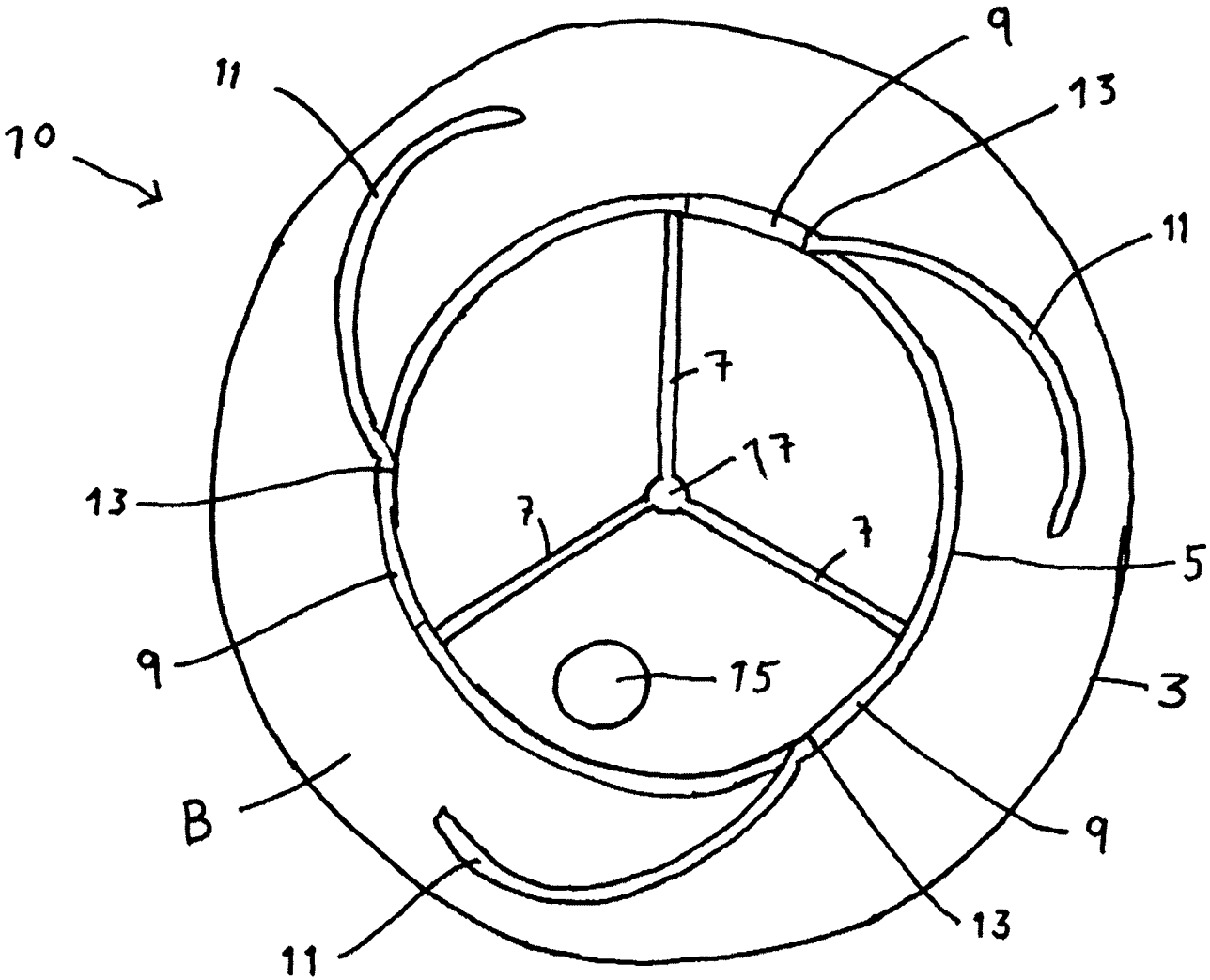
FIG. 2 shows a bottom view of a cover according to one embodiment of the invention.

In FIG. 2 is shown a bottom view of a cover 10 according to one embodiment of the invention. The respective locations of the base portion 3, circular rib 5, risers 9, and contact shoes 11 are shown, as well as the rib segments 7 and center hub 17. Also shown are the intersections 13, which are the locations at which the contact shoes 11 are attached to the risers 9. In one embodiment, the risers 9 are contoured to have a curvature which substantially matches that of the circular rib 5. In one embodiment, the contact shoes 11 comprise an outer convex surface, and an inner concave surface, and the contact shoes 11 overall contour does not coincide substantially with the circular rib 5 as viewed from this perspective view of FIG. 2. Having the contact shoes 11 contoured in such fashion, coupled with their being attached to the risers 9 at the intersections 13 permit some movement of each of the contact shoes 13 independently from the relatively stationary position of the risers 9 in a direction shown by the double headed arrow depicted in FIG. 5, which movement is generally describable as being towards and away from the center of the base portion 3. Thus, when a cover 10 is produced in the configuration shown in FIG. 2 from a thermoplastic material, there will be an inherent mechanical bias imparted to the contact shoes in the event they are moved in either direction indicated by the double arrow shown in FIG. 5. By such configuration, the contact shoes 11 can each be pushed slightly towards the center point of the base portion 3, and when this is done, they will resist such pushing slightly and have a slight mechanical bias back towards their original position. This effect is of utility, when the inside diameter of the terminal portion of a conduit which is desired to be covered is slightly less than the diameter of an imaginary circle drawn to be tangential to each of the contact shoes 11, for in such case, one may push or compress the contact shoes inwardly towards the center point of the base portion 3, and insert the assembly having the contact shoes 11 so compressed into the conduit, so that the bottom surface B of the base portion 3 is facing the interior of the conduit. Upon release, and after being positioned within the confines of such a conduit, the contact shoes, by their inherent mechanical bias, from the energy stored by their compression, will exert a force that is oriented in a direction that is pointed outwardly from the centerpoint of the base portion 3, towards the inner wall W (FIG. 6) of such a conduit, until the contact shoes 11 contact the inner wall of the conduit, thus providing a securing force for the cover 10 in its installed position at the terminal end of the conduit.

Figure 3:
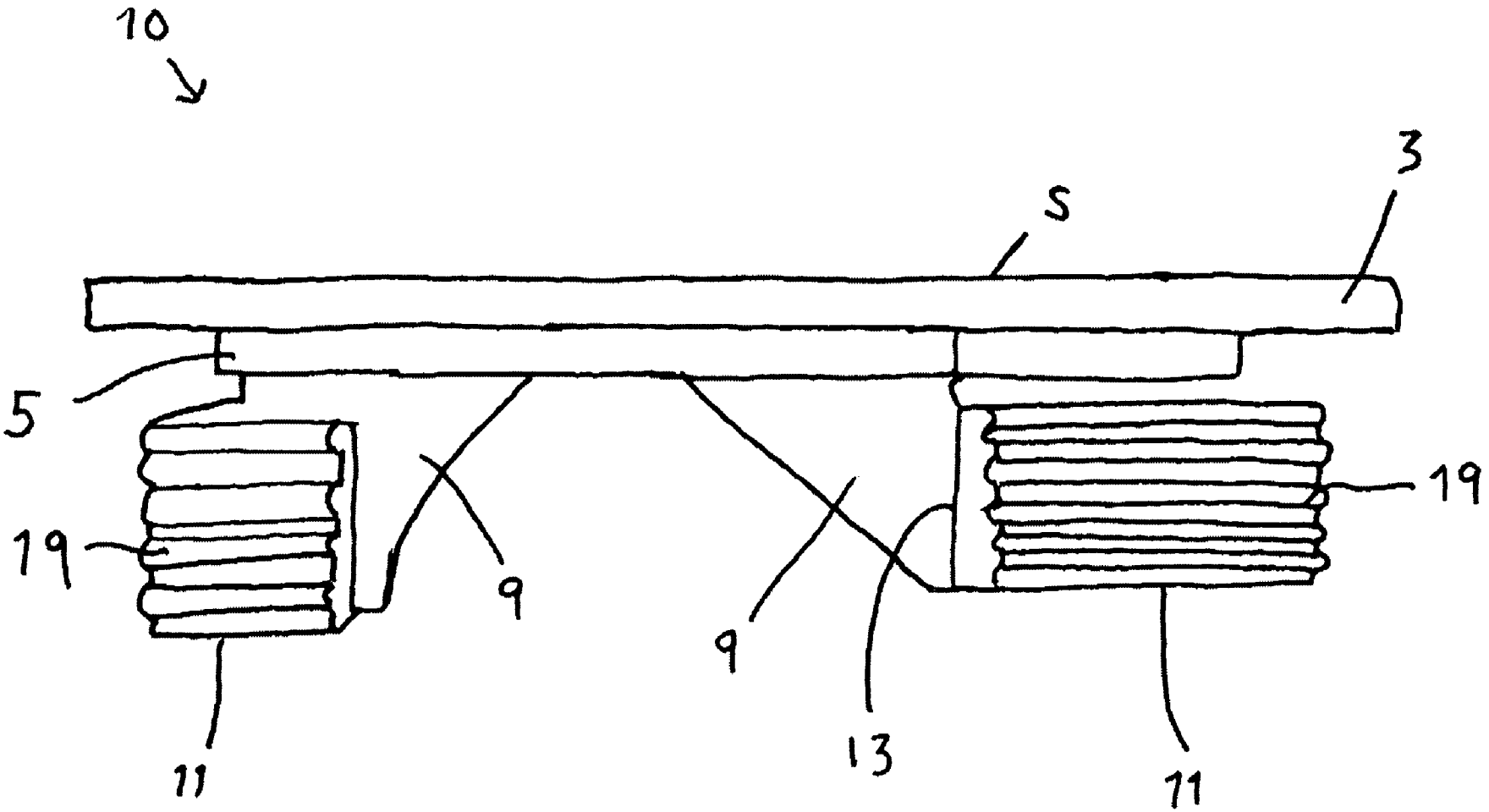
FIG. 3 shows a side perspective view of a cover according to one embodiment of the invention.

In FIG. 3 is shown a side perspective view of a cover 10 according to one embodiment of the invention, showing the respective locations of the base portion 3 and its top surface S, the circular rib 5, risers 9, contact shoes 11, and intersection 13. In one embodiment, the convex surfaces of the contact shoes 11 may have a surface texture 19 on them, which texture may include knurling or ribs, cast or machined onto the convex surface of the contact shoes 11. Although described as being shaped substantially triangular as viewed from a side perspective such as that in FIG. 3, the risers 9 may have other shapes as well, including rectangular, or any irregular shape, with a main proviso in one embodiment being that the risers 9 should be connected to the circular rib along one of their edges, and should also have a contact shoe 11 disposed at another of its edges, so that the longest length dimension of the contact shoe is disposed to be substantially parallel to the bottom surface B of the base portion 3. Other embodiments have this longest length dimension being non-perpendicular to the bottom surface B of the base portion 3, including orientations in which it is skew thereto.

Figure 4:
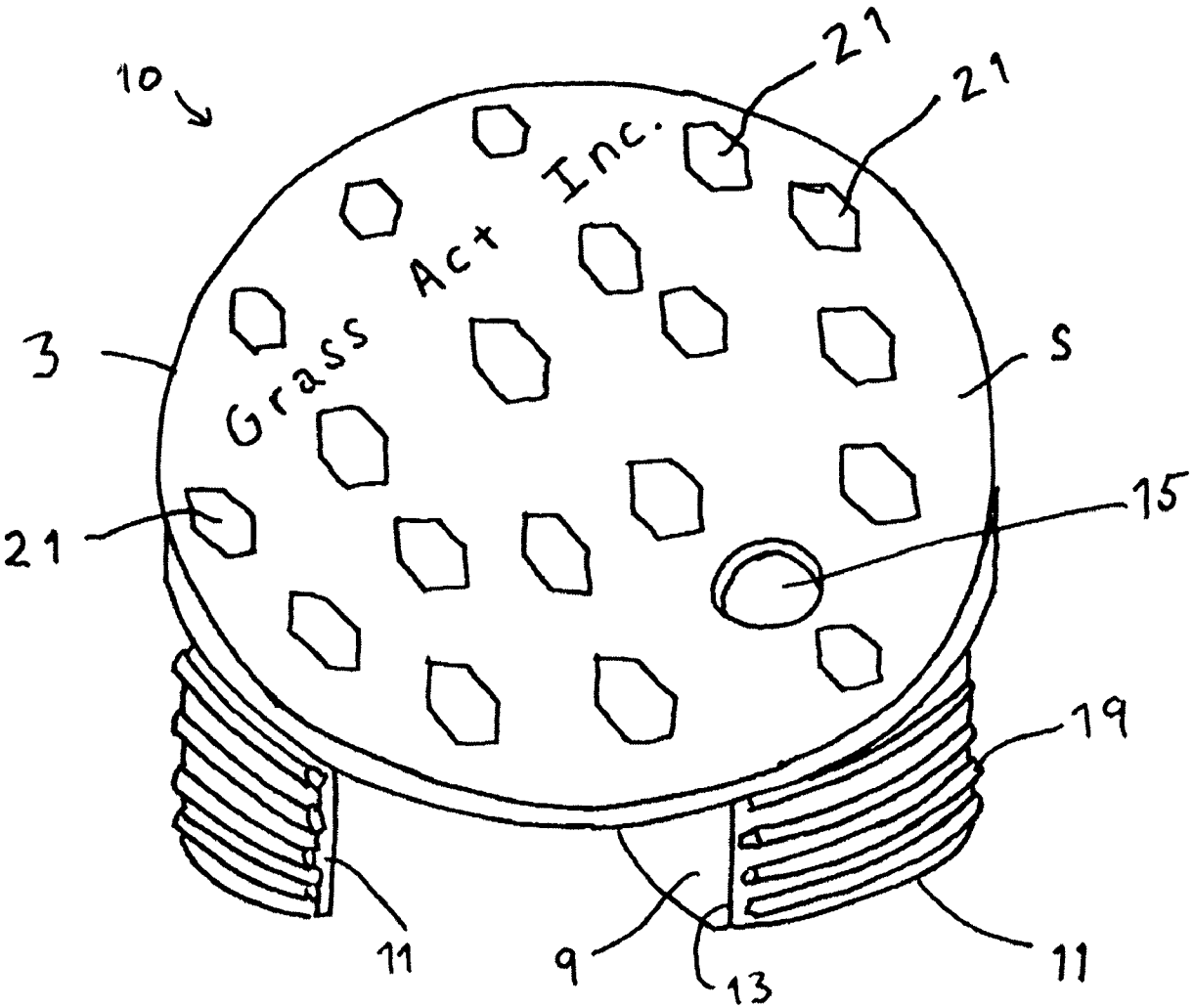
FIG. 4 shows a perspective view of the top of a cover according to one embodiment of the invention.

FIG. 4 shows a perspective view of the top of a cover 10 according to one embodiment of the invention, showing the respective locations of the base portion 3 and its top surface S, riser 9, contact shoes 11 having texture ribs 19, and intersection 13. Hole 15 is shown, as well as optional surface texture 21. The optional surface texture 21 may be any irregularity on the top surface S, including depressions, or protrusions, in any shape, including cross-hatchings, knurling, or depressions or protrusions of any geometric shape disposed in any pattern on the top surface S.

Figure 5:
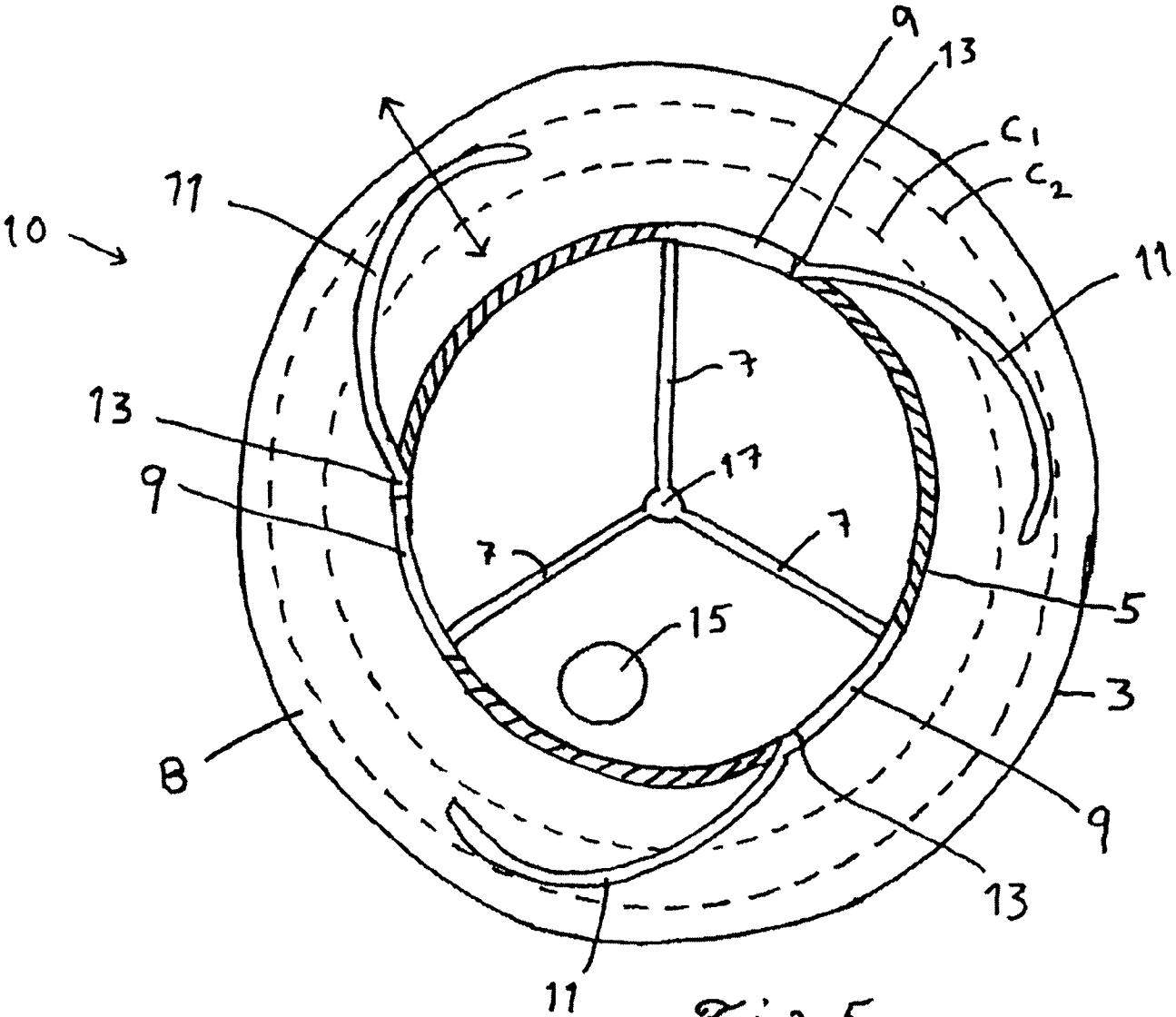
FIG. 5 shows bottom perspective view of a cover according to one embodiment of the invention.

In FIG. 5 is shown a bottom view of a cover 10 according to one embodiment of the invention. In this embodiment, the respective locations of the base portion 3, circular rib 5, risers 9, and contact shoes 11 are shown, as well as the rib segments 7 and center hub 17. Also shown are the intersections 13, which are the locations at which the contact shoes 11 are attached to the risers 9. From this view, the risers 9 are seen to be contoured to have a curvature which substantially matches that of the circular rib 5. In one embodiment, the contact shoes 11 comprise an outer convex surface, and an inner concave surface, and the overall contour of the contact shoes 11 collectively departs from or is non-coincident with the circular rib 5, as compared with the risers 9. Having the contact shoes 11 contoured in such fashion, coupled with their being attached to the risers 9 at the intersections 13 permit movement of each of the contact shoes 13 in a direction shown by the double headed arrow, which potential movement is generally describable as being either towards or away from the center of the base portion 3. By such configuration, the contact shoes 11 can each be pushed slightly towards the center point of the base portion 3, and when this is done, they will resist further such pushing slightly and acting analogously to springs, each will have a slight mechanical bias back towards their original position following application of an unbalanced force, such as pushing. This effect is of utility, when the inside diameter of the terminal portion of a conduit which is desired to be covered, such as that defined by dashed circle $C_1$, is slightly less than the diameter of an imaginary circle drawn to be tangential to each of the contact shoes 11 when in their equilibrium position (with no force applied), such as dashed circle $C_2$, for in such case, one may push or compress the contact shoes inwardly towards the center point of the base portion 3, and insert the assembly having the contact shoes 11 so compressed into the conduit (FIG. 6), so that the bottom surface B of the base portion 3 is facing the interior of the conduit. Upon release, and after being positioned within the confines of such a conduit, the contact shoes, by their inherent mechanical bias, from the energy stored by their compression, will exert a force that is oriented in a direction that is pointed outwardly from the centerpoint of the base portion 3, towards the inner wall W (FIG. 6) of such a conduit, until the contact shoes 11 contact the inner wall of the conduit, thus providing a securing force for the cover 10 in its installed position at the terminal end of the conduit, which may include frictional engagement between the contact shoes 11 and the wall W of the conduit. Shown in FIG. 5 also are the locations of the rib segments 7, center hub 17, and hole 15.

According to an alternate form of a cover provided herein, the segments of the circular rib 5 containing hash marks in FIG. 5 may be omitted, in which embodiments the circular rib 5 will then instead be replaced with a structure comprising a plurality of circular rib segments, each of which circular rib segments have a riser and contact shoe attached thereto as hereinbefore described. The location of such circular rib segments so resulting may be disposed in any location earlier specified for the circular rib itself, with respect to the outer circumferential edge of the base portion 3.

Figure 6:
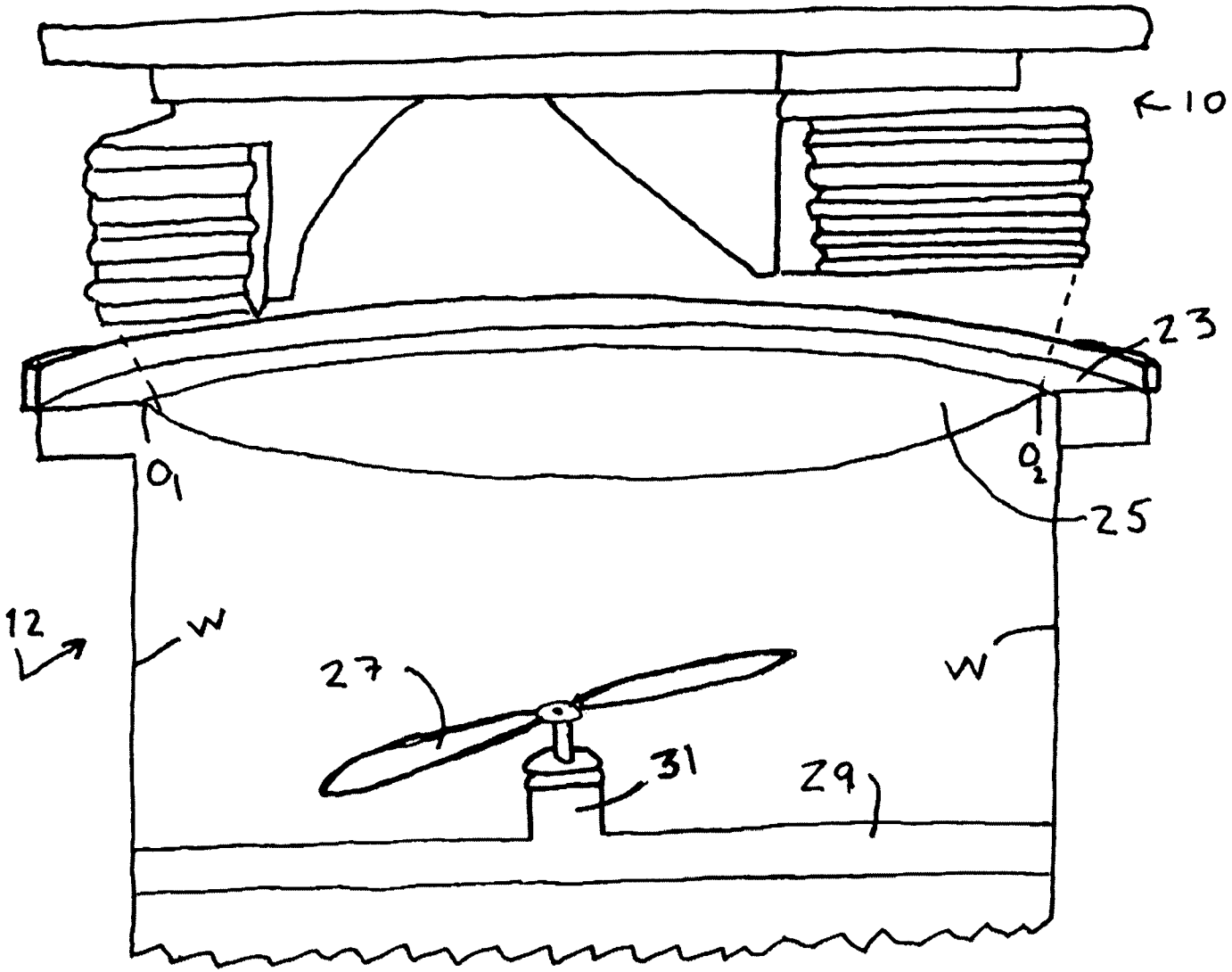
FIG. 6 shows a side perspective view of a cover according to one embodiment of the invention and its relation to an access conduit which it is intended to be capable of covering.

FIG. 6 shows a side perspective view of a cover 10 according to one embodiment of the invention and its relation to an access conduit 12 which it is intended to be capable of covering. The access conduit 12 is typically disposed in a subterranean location, with its terminal end or lip portion 23 being at ground level. The conduit 12 has an opening 25, at its terminal end, as is known in the art. In typical installations, there is disposed within the conduit a control device, which may be a switch, valve or the like. In FIG. 6, the control device is a valve 31 having a handle 27, which controls the flow of water through pipe 29, which may be a water pipe. In one embodiment, the lip 23 of the conduit 12 is contoured to be capable of receiving the circumferential edge of the cover 10 so as to render the cover/conduit assembly to have a flat top surface, with the top surface S (FIG. 4) of the base portion comprising that flat top surface. The opening 25 of the conduit 12 has a diameter dimension that is exemplified by the points $O_1$ and $O_2$ at opposite points along the terminal portion of the conduit. In one embodiment, the distance between points $O_1$ and $O_2$ of the conduit 12 corresponds to the diameter of dashed circle C1 in FIG. 5. However, dashed circle C1 shall not be construed as being a boundary of the movement of the contact shoes 11, and the scope of their motion can include extension inwardly all the way to the circular rib 5 or even more towards the center of the base portion 3. Thus, to install cover 10 onto the opening of the conduit 12, one may manually press the contact shoes 11 inward towards the center hub 17 of the cover 10, and place the portion of the cover 10 which comprises the contact shoes 11 into the opening of the conduit. The pressing on the shoes is released, thus causing the contact shoes 11 to press outwardly against the wall W, securing the cover 10 fixed in position by the outward mechanical bias of the contact shoes 11, and gravity, to some extent. The cover 10 is then pressed downward so that the circumferential edge of the base portion 3 rests within the lip portion 23 of the conduit 12. To remove the cover 10 from a conduit once installed, one merely places a finger through the hole 15 (FIG. 4) and pulls the cover 10 away from the conduit 12.

Although shown and described as having three risers 9 and contact shoes 11, alternate embodiments of a cover 10 includes embodiments having two, four, five, six, and more of such combinations disposed along a circular rib 5 as described herein for the embodiments having three of such combinations. In preferred embodiments, such pluralities of risers and contact shoes are spaced equidistantly from one another along the circular rib 9, although this is not absolutely necessary.

A base portion 3 may be thought of as being a flat circular body for those embodiments in which is generally shaped like a disc and is dimensioned to overlie and close an opening on a conduit (which conduit may include valve boxes and underground landscape boxes of the type having an upper circular opening and a generally cylindrical inner wall with an engagement ring defining an annular shoulder) as such are known in the art.

Figure 7:
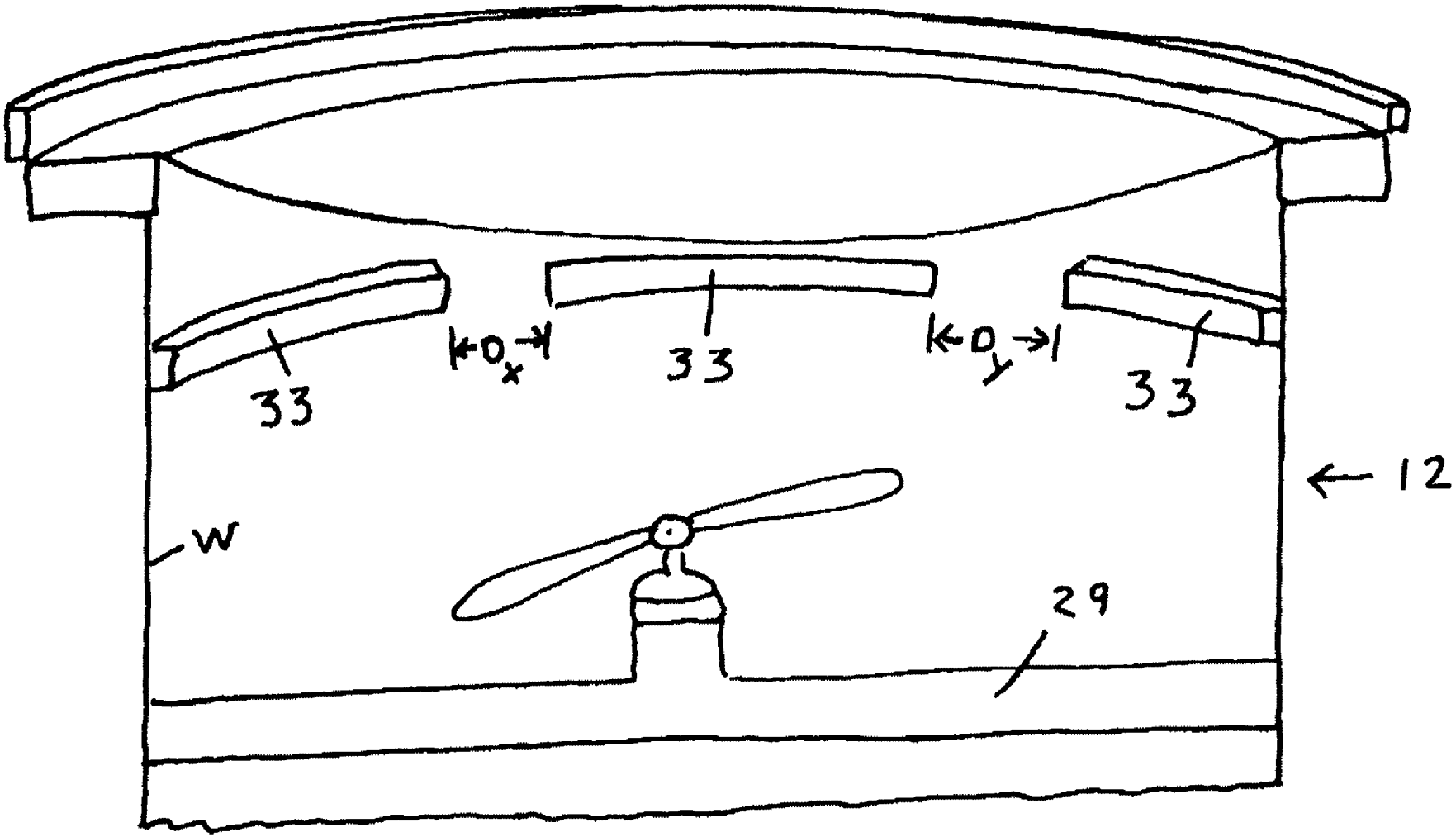
Fig. 7 (PRIOR ART)
FIG. 7 shows a side perspective view of the top open portion of an access conduit.

FIG. 7 shows a side perspective view of the top open portion of an access conduit 12 similar to that shown in FIG. 6, excepting that in this instance there is an engagement ring present on the inner wall W of the conduit, as such engagement rings are commonly encountered and are well-known in the art. Such an engagement ring may be completely coextensive with the inner wall W of the conduit, or may be present in the form of a plurality of segments 33, as shown disposed on the inner wall of FIG. 7, having distances Dx and Dy between the engagement ring segments 33, which distances Dx, Dy may be the same or different from one another.

Figure 8:
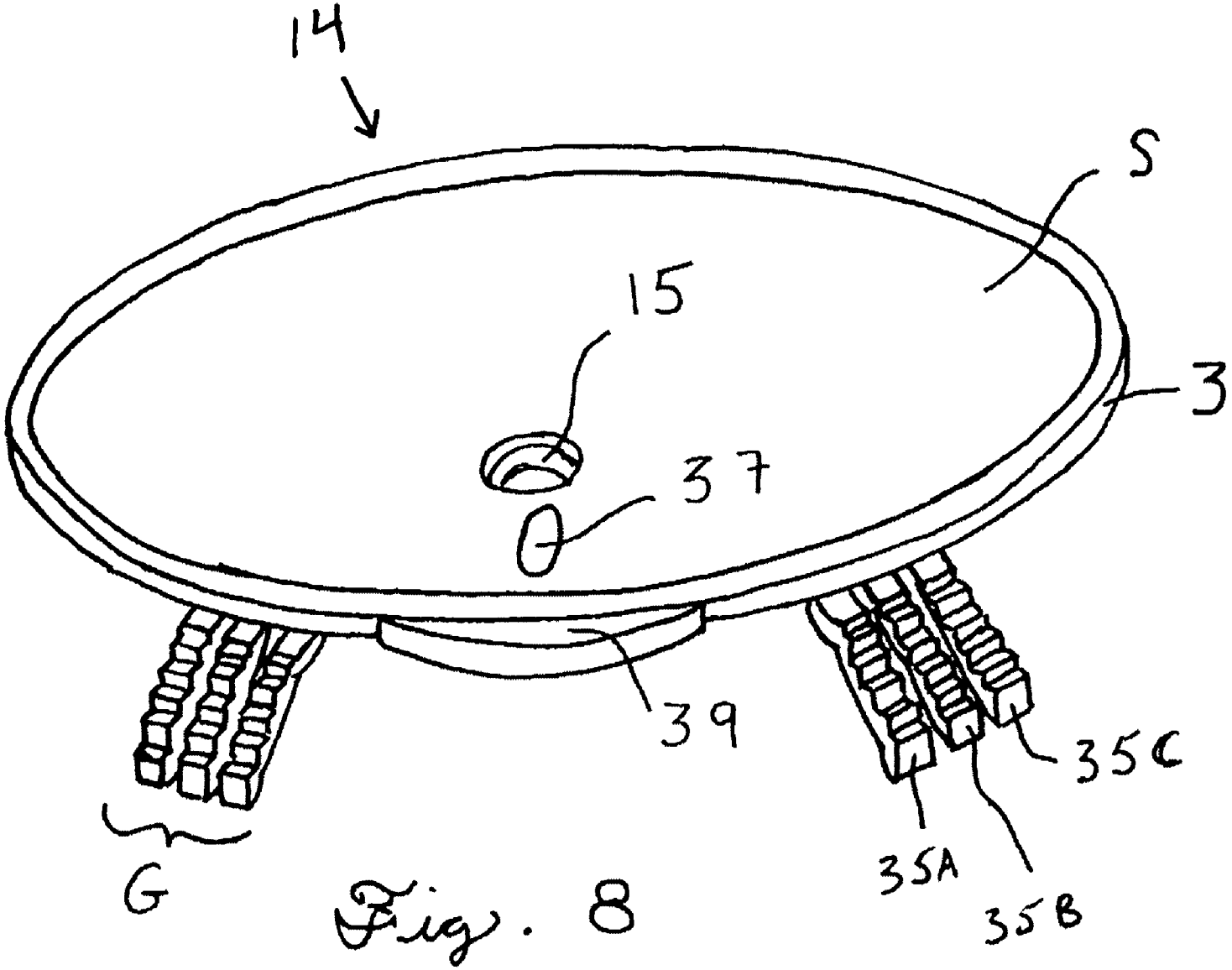
FIG. 8 shows a perspective view of the top of a cover according an alternate embodiment of the present disclosure.

FIG. 8 shows a perspective view of the top of a cover 14 according an alternate embodiment of the present disclosure. Such cover 14 includes a body, which is base portion 3 having a top surface S. Disposed on the top surface S is a knockout provision over a hole 15 which enables a user to knockout a portion of the top surface S to reveal a hole disposed therethrough, as such knockout provisions are well-known in the art. At the location specified as 37 there is a second knockout provision, concealing a hole, which hole can be useful for passing a bolt through the top surface S of the cover 14 to secure the cover 14 in place once it has been disposed over the top of a conduit, such as 12 in FIG. 7. There are also a plurality of groups G of individual stability tangs 35A, 35B and 35C which are attached to the bottom B of the base portion 3 and extend away from the bottom surface B of the base portion 3. In one embodiment, the stability tangs 35A, 35B and 35C are attached directly to the bottom surface B of the base portion 3, and in an alternate embodiment the stability tangs 35A, 35B and 35C are attached to the bottom surface B of the base portion 3 at a circular rib 5 (FIGS. 9, 11) as was present on cover 10. There is also shown in FIG. 8 a grasping tab 39 that is useful in assisting an operator in lifting a cover 14 from a conduit 12 in/on which it is disposed.

Figure 9:
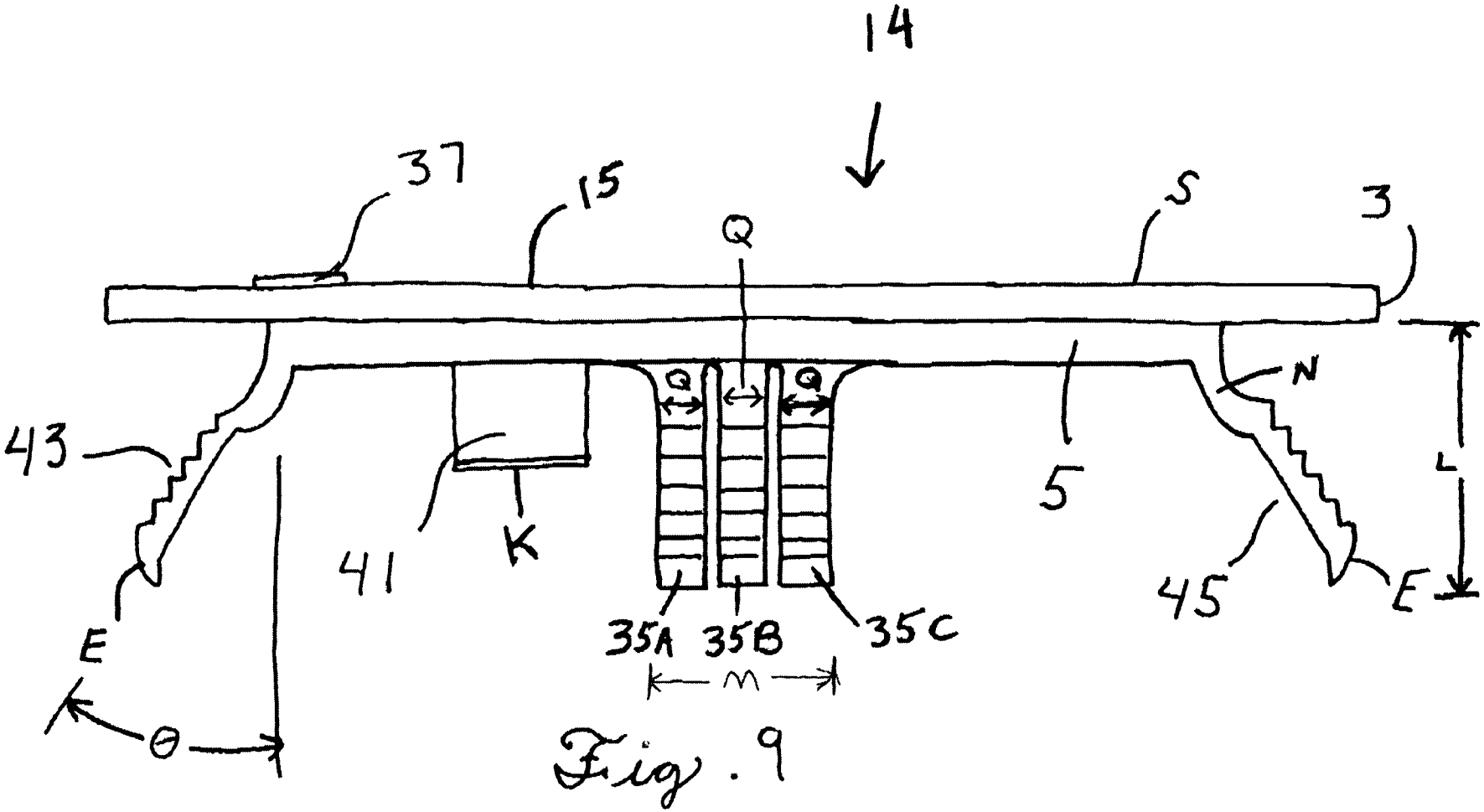
FIG. 9 shows a side perspective view of a cover according to an alternate embodiment.

FIG. 9 shows a side perspective view of a cover 14 according to an alternate embodiment, showing the respective locations of the base portion 3, top surface S, circular rib 5, hole 15, which may include an optional well 41, which is a hollow cylinder that is open on the top surface S wherein the knockout provision is disposed at the bottom of the well 41 at location K. The knockout 37 is also shown. From this view is seen that the stability tangs in one embodiment each comprise an outer surface 43 having notches, steps, ratchetings, flutings, knurlings, or any other non-smooth texture thereon, a linear inner surface 45 (which may also be curved), and an outer edge E.

Another feature of the stability tangs 35A, 35B and 35C is that in preferred embodiments they are each selectively and easily removable from the base portion 3 (or circular rib 5) at their neck portion N by a user, in similar fashion as a knockout provision is removable, the importance of which feature shall be made apparent below in reference to FIG. 12. Easily removable means that the stability tangs 35A, 35B and 35C can each be removed from the cover 14 using no more force than is necessary to remove a conventional knockout provision from either a polymeric or metallic common electrical box used in residential wiring installations, such as wall outlet boxes, generally only requiring a poking with an instrument such as a screwdriver or twisting with pliers, and a few subsequent bendings back and forth until the neck material suffers stress fatigue until the stability tang comes free. The same methods may be employed to make the individual stability tangs easily removable from the base portion 3 as were employed relative to the contact shoes 11 for cover 10, including scoring the neck portions N, or fabricating the cover 10 from polypropylene and the neck portions N being polypropylene hinges, as such are well known in the art of molded polypropylene articles. In either embodiments 10 or 14, the use of polymers other than polypropylene facilitates the ease of removal of the contact shoes 11 or stability tangs 35A, 35B, 35C, etc.; however, even when polypropylene is employed a simple snip of scissors is typically sufficient, thus making removal easy, when desired. Towards this end, fabricating the neck portion N to have a thickness that is less than the remaining portion of the stability tangs is of utility. This disclosure includes other embodiments in which the stability tangs 35A, 35B and 35C are more rigidly attached, and must be cut off using a wire-cutter, scissor, tin snips, or other cutting implement.

Figure 10:
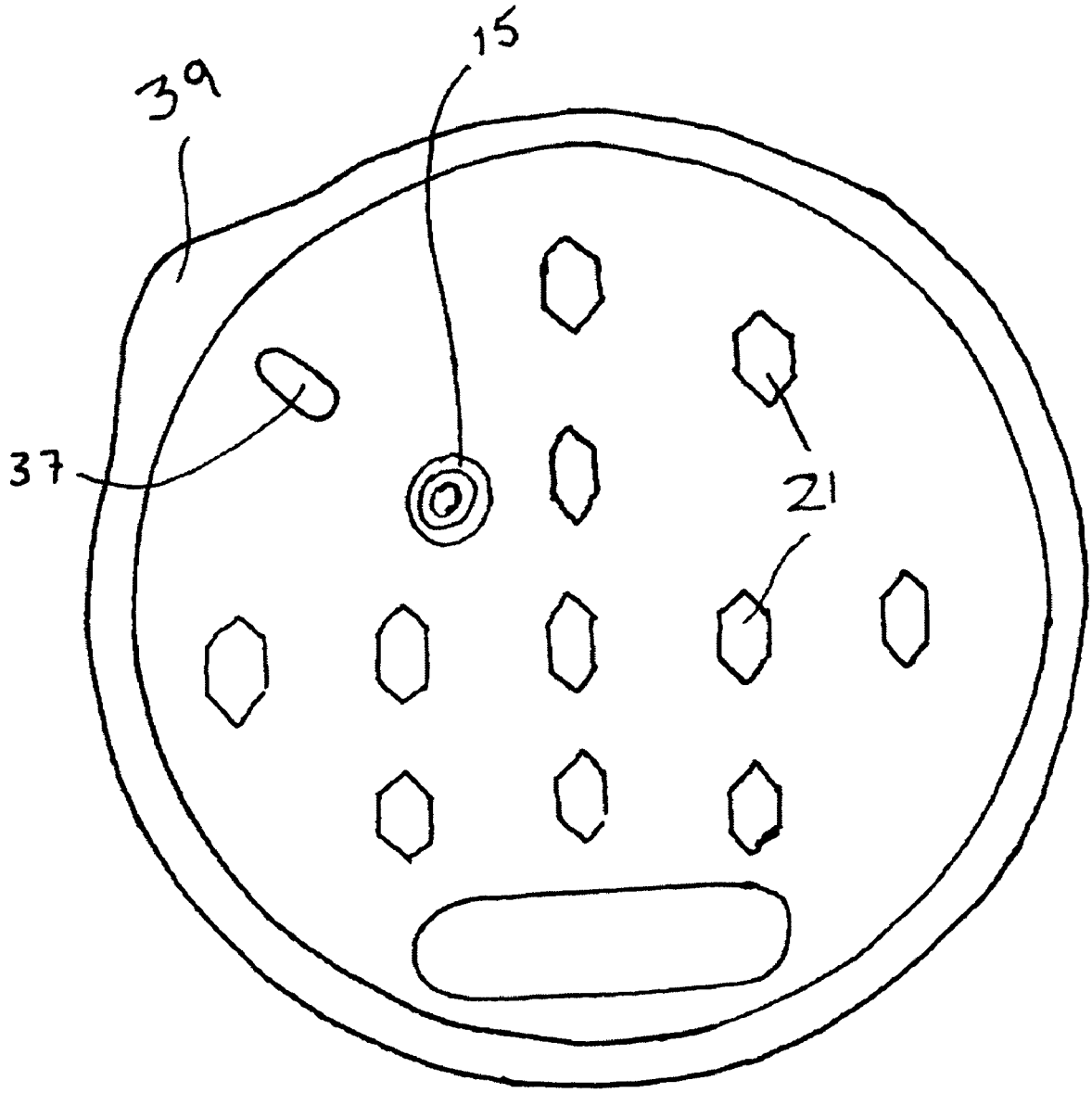
FIG. 10 shows an overhead view of a cover according to an alternate embodiment of the disclosure.

FIG. 10 shows an overhead view of a cover 14 according to an alternate embodiment of the disclosure, showing the respective locations of the tab 39, hole 15 with knockout provision in the well 41, and the knockout at 37.

Figure 11:
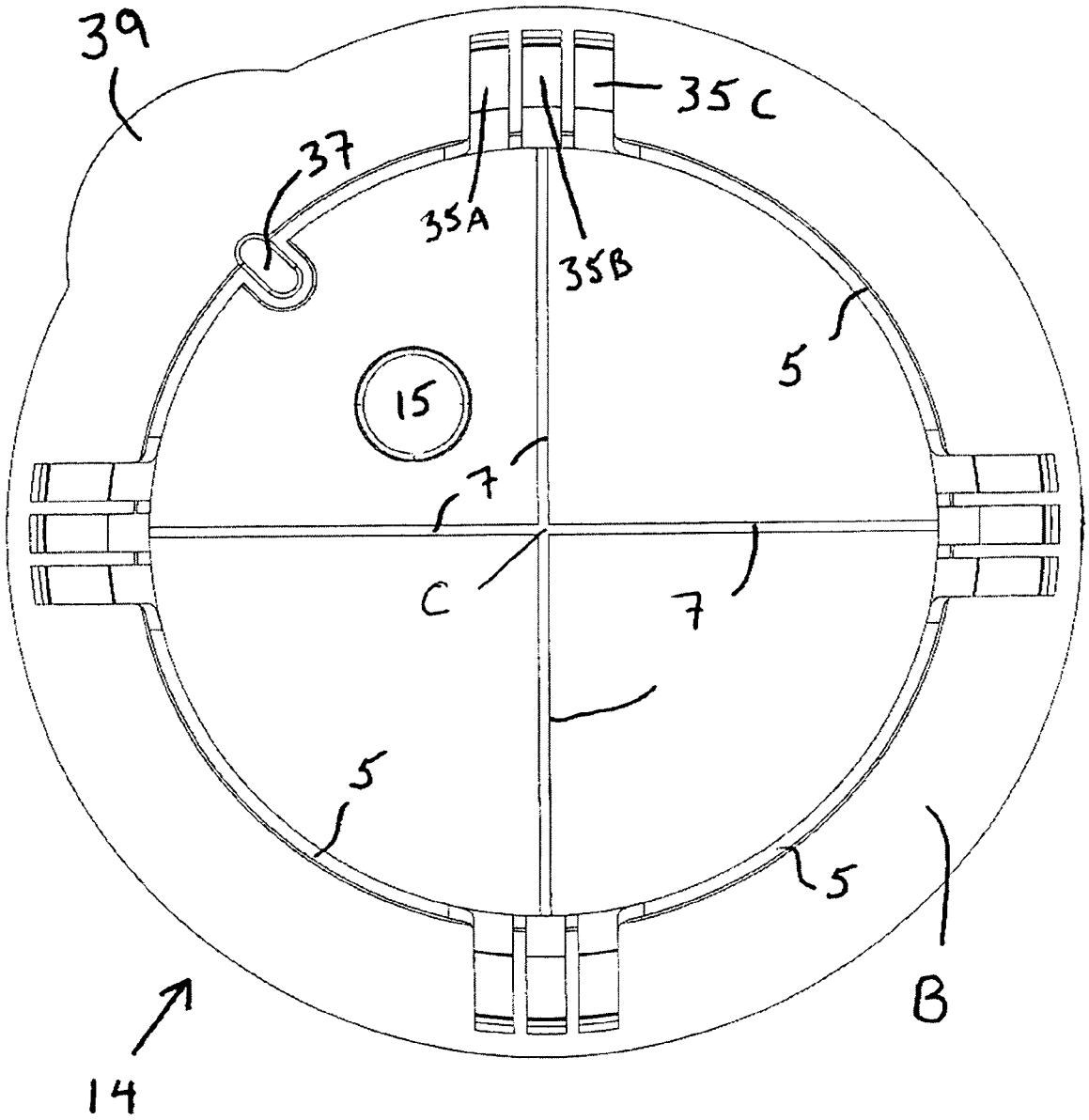
FIG. 11 shows an underside view of a cover according to an alternate embodiment of the disclosure.

FIG. 11 shows an underside view of a cover 14 according to an alternate embodiment of the disclosure showing the respective locations of a plurality of groups of stability tangs such as 35A, 35B, 35C. In this embodiment, there are four groups of such stability tangs, disposed at the twelve o'clock, three o'clock, six o'clock and nine o'clock positions. However, the present disclosure provides covers such as that shown in FIG. 11 having any number of groups of stability tangs between two and twelve, inclusive (i.e., including two and twelve), wherein each of the groups may comprise any number of individual stability tangs between one and six, inclusive (i.e., including one and six). In preferred embodiments, the groups of stability tangs are disposed on the same circular path on the bottom surface B of the base portion 3 having a centerpoint substantially corresponding to the center of the base portion 3, the groups of stability tangs thus being equidistantly spaced from one another along that circular path, and are all thus inherently disposed at the same (or substantially the same, in alternate embodiments) distance from the center C of the bottom surface B of the cover 14. In one embodiment, the stability tangs are disposed at the circumference of the base portion 3. In another embodiment, the stability tangs are disposed near the circumference of the base portion 3. Within the instant description, "near" means any distance within about 3 centimeters from the circumferential edge of the base portion 3. The respective locations of the tab 39, hole with knockout 37, hole 15, circular rib 5, and rib segments 7 are also shown.

Figure 12:
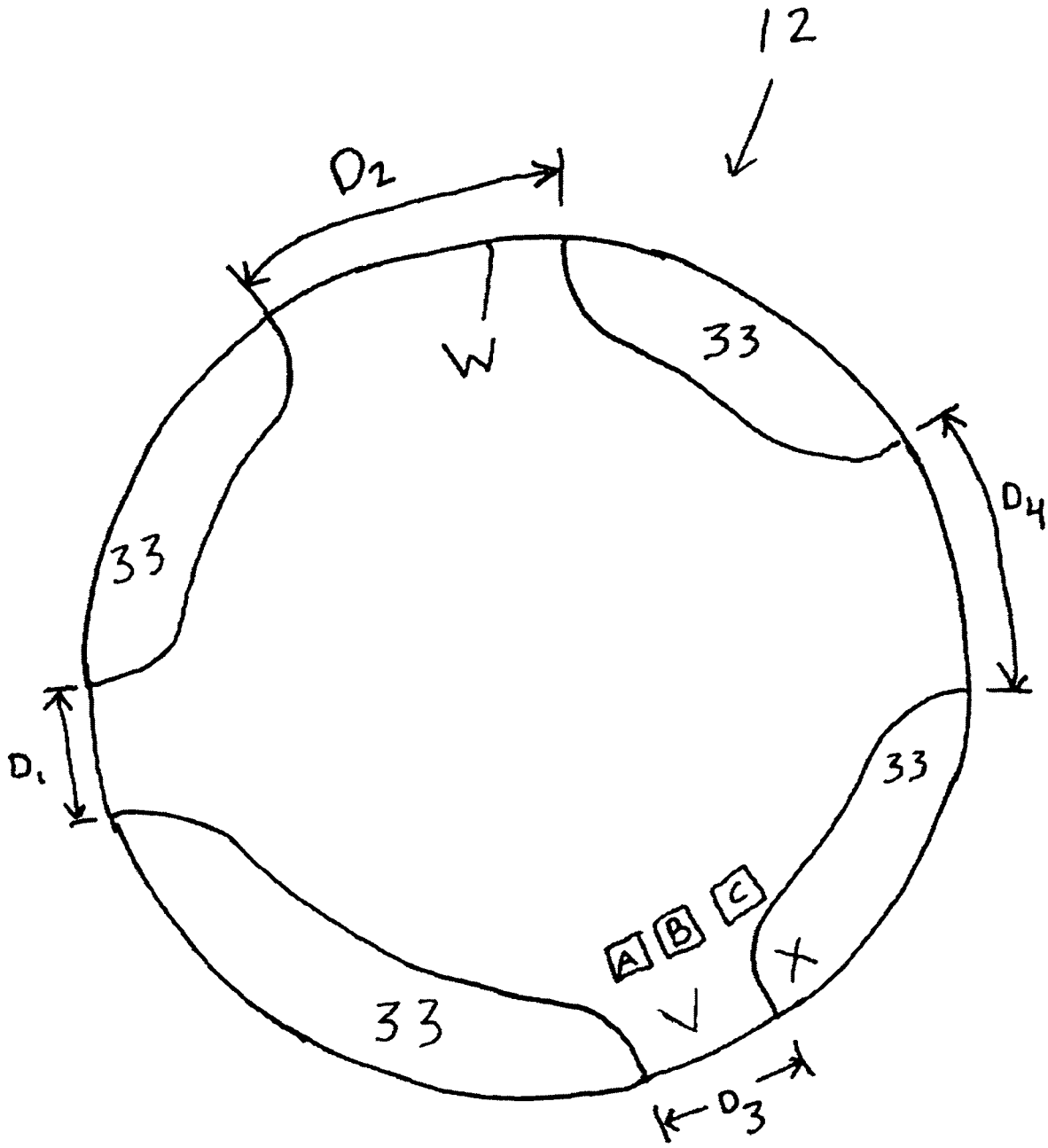
Fig. 12 (PRIOR ART)
FIG. 12 shows an overhead view of the open end of a conduit according to the prior art.
Figure 13:
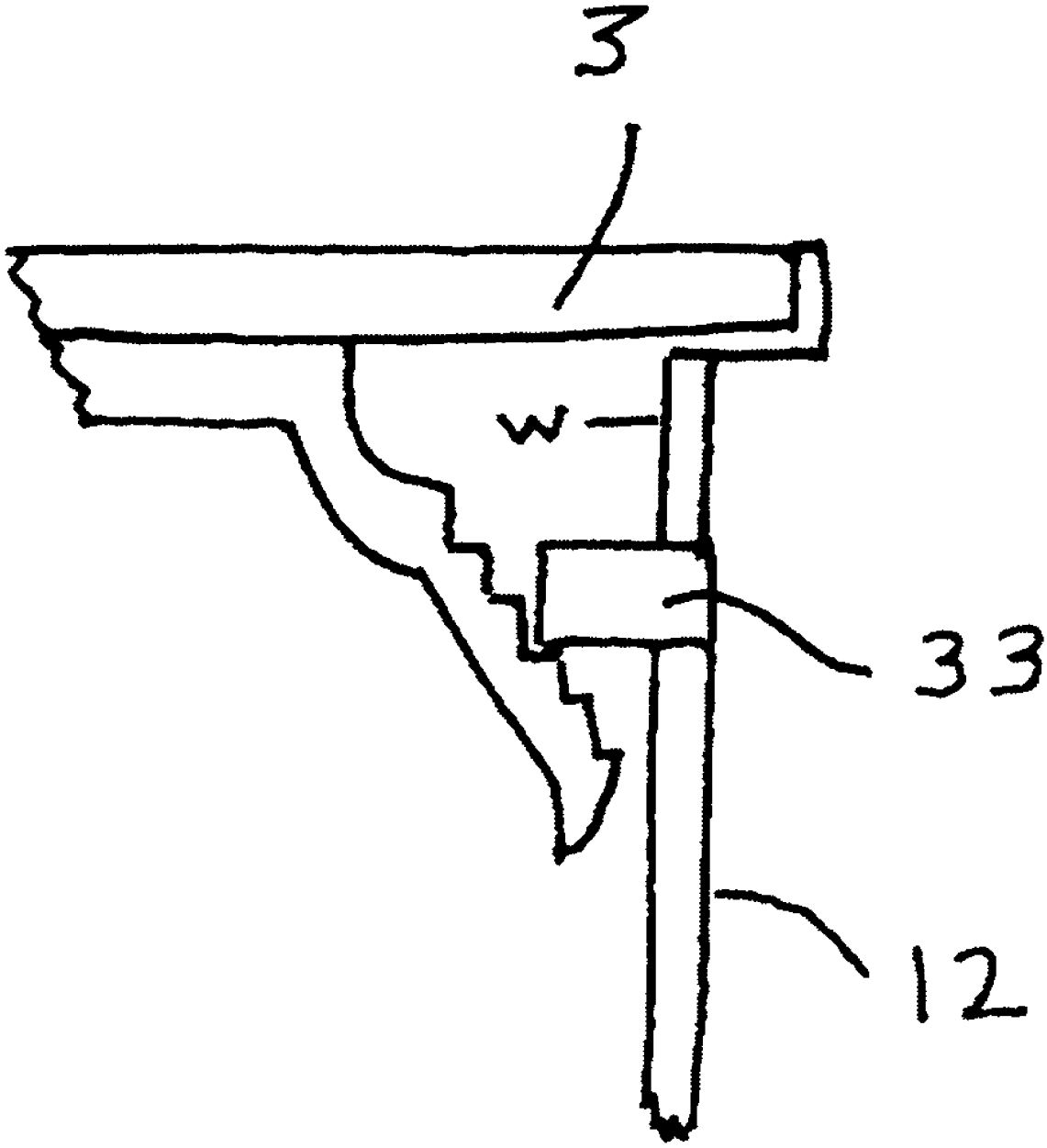
FIG. 13 shows the engagement between a stability tang of a cover according to one embodiment of the disclosure and an engagement ring segment on a conduit.

FIG. 12 shows an overhead view of the open end of a conduit according to the prior art. In FIG. 12 are seen the engagement ring segments 33 disposed on the inner wall W of the conduit 12. In the prior art, and in field use, are conduits having different configurations of engagement ring segments, which typically have differing amounts of distance between the ends of individual ring segments 33, which different distances are exemplified by D1, D2, D3 and D4, and which distances correspond effectively to "voids" in or between the engagement ring segments. In practice, a cover 14 such as that shown in FIG. 9 is desired to be disposed over the opening of the conduit 12. For cases where the openings or voids in the engagement ring segments, such as D1, D2, D3 and D4 correspond to the locations and overall widths of the groups of stability tangs on the underside of the cover 14, all that is necessary is for one to line up the groups of stability tangs with the voids between the engagement ring segments, lower the cover, and then optionally turn it slightly. By turning the cover after the engagement tangs have passed through the voids between the engagement ring segments, this permits a portion (one of the steps) of the stepped outer surface 43 (FIG. 9) to engage with, ride on, rub up against, or otherwise provide a retaining force between the cover 14 and the engagement ring segments 33 as shown in FIG. 13. Then, if the user desires, a bolt may be passed through the hole at 37 to secure the cover 14 in position.

One desired object of the present disclosure is to provide a conduit cover which is capable of being adapted to the ends of a large number of existing conduits. However, since many of the conduits of the prior art have different void distances between the ends of their engagement ring segments, presently no single cover is capable of being adapted to a large number of existing conduits. However, by my invention I have provided the covers herein to be so capable. This is exemplified in the overhead view of FIG. 12, wherein the square boxes labeled A, B, and C represent potential locations of stability tangs with respect to the engagement ring segments 33 when a cover having features described herein for a cover 14 is lowered onto a conduit opening, which in this illustrative instance is into the plane of the paper. The stability tangs at locations represented by squares A and B in FIG. 12 have no problem descending the void space V between the ends of adjacent engagement rings 33; however, the stability tang whose position is specified by the location of the square labeled C cannot pass, its downward movement, and hence the entire downward movement of the cover 14, being obstructed by that portion labeled X on the engagement ring 33. However, all one must do in such instance, is remove the stability tang from the cover 14 that is located at the location defined by the square box labeled C in FIG. 12 and the remaining two stability tangs at A and B can easily pass through the void in the space D3, thus enabling the cover to be lowered over the conduit, and then turned so that the stepped portion 43 of the stability tangs can engage, abut, etc. with an engagement ring segment as aforedescribed. In some embodiments, the edge E (FIG. 9) of the stability tangs may contact the inner wall W of the conduit 12, depending on the dimensions of the conduit box opening, the engagement ring segments and stability tangs. In other embodiments, they do not. In one embodiment, the stability tangs such as 35A, 35B, 35C are part of a cover 14 which is single construct, being made by an injection molding process, and these stability tangs, being comprised of a polymeric material, have inherent flexibility. However, any attempt to flex them inwardly or outwardly towards or from the center of the cover, will result in a mechanical bias in the neck portion N of the stability tang, which can provide an engaging force against the engagement ring segment disposed on the inner wall of the conduit 12 when they are flexed inwardly. In the embodiment of FIGS. 8, 9, 10, 11, the stability tangs do not have leading edges and/or trailing edges.

In further embodiments of existing prior art conduit boxes, there are few or no engagement ring segments present on the inner wall of the conduit, but there are recesses in the surface of the inner wall W. The stability tangs as provided herein are in these instances capable of engaging with such recesses to provide a securing force for the cover 14 as a whole.

In some embodiments, the distance that the stability tangs extend from the bottom surface of the cover 14, denoted by the dimension L in FIG. 9, is desirably any distance in the range of between about three and six centimeters, with a distance between about four and five centimeters being preferred. The overall width of a group of stability tangs, denoted by the dimension M in FIG. 9 is preferably any value in the range of between about one and four centimeters, with a width of between about two and three centimeters being preferred. In one especially preferred embodiment, there are three stability tangs in each group, there are four groups of stability tangs, the width M is 3.2 centimeters and the dimension L is about 4.75 centimeters, with a space of about 0.32 cm existing between adjacent stability tangs in the group. In some embodiments, the width of a group of stability tangs M is less than the distance L that the stability tangs extend from the bottom surface of the cover. In other embodiments, the width of a group of stability tangs M is greater than the distance L that the stability tangs extend from the bottom surface of the cover. Individual stability tangs may have any width Q in FIG. 9 between about two millimeters and about fifteen millimeters, with a width Q of between about five millimeters and twelve millimeters being preferred. Each of the stability tangs within a given group need not be of identical widths, as in some embodiments they are of identical widths Q, while in other embodiments two have different width Q and in further embodiments all are of different width Q. The distance between individual stability tangs within a given group of stability tangs may be any distance between about one millimeter and 10 millimeters.

The stability tangs haven a longest length dimension, which is longer than their width and their thickness. FIG. 9 shows the angle theta θ that the longest length dimension of the stability tangs may make with respect to a line drawn perpendicular to the top surface of the base portion 3, when a cover according to the disclosure is free-standing and not installed on a conduit box, valve box, etc. In some embodiments, this angle θ is about 45 degrees. In other embodiments, this angle θ is about 30 degrees. In further embodiments, this angle θ is about 60 degrees. However, any angle theta θ in the range of from about 10 degrees to about 80 degrees is suitable, more or less, and depending on the features of the conduit box to which it is contemplated covering with a cover 10, 14 etc. according to this disclosure. When a cover according to the disclosure is installed on a conduit box, valve box, etc., the angle θ will be less than the case of the free-standing cover, and may be any angle in the range of between about zero degrees and about 70 degrees.

In other embodiments, a cover such as 10 of FIG. 1 may have its contact shoes 11 attached at the intersection 13 in a way that makes their removal as easy or effortless as removing a knockout from an electrical box.

Thus, the selective and easy removability of the stability tangs, coupled with their initial location and disposition on the cover, render a cover according to this disclosure very versatile with regards to the number of prior art conduit boxes it is capable of covering in a secured fashion. This versatility reduces the need for the current practice of the manufacture of a large number of different covers, and reduces warehouse stock requirements and will doubtlessly save energy and time of all personnel involved in covering conduit boxes.

In alternate embodiments, the contact shoes 11 and stability tangs 35 may be considered as collectively comprising a plurality of circumferentially spaced flexible flaps formed integrally with, fixed to and extending downwardly from the underside of the flat circular body that comprises the base portion, wherein the flaps have trailing edges which are adapted to deflect radially inwardly to provide frictional engagement with the inner wall and/or the engagement ring of the landscape box. In other embodiments, a cover provided herein includes flexible flaps (contact shoes stability flaps or functional equivalents thereof) which are not adapted to provide frictional engagement with both the inner wall and the engagement ring of the landscape box, but only with either the wall W alone, or an engagement ring (FIG. 7) alone.

For purposes of describing some embodiments taught by this specification, the leading edges may in some embodiments be considered as being either the intersections 13, or the portion or edge of the riser 9 which is forward with respect to the contact shoe 11 which is attached to it, and the trailing edge may be considered as being that portion of the contact shoe 11 which contacts the wall of a conduit in which a cover provided hereby is installed. While the contact shoes may be curved as previously described, they may in some embodiments be linear as viewed from the perspective shown in FIG. 5.

A cover as provided hereby may have any diameter dimension suitable to enable it to cover an access conduit, but is typically any diameter between about 12 centimeters and 30 centimeters.

Additionally, any cover as provided herein and in the parent case of this application may be provided with slots or other holes disposed through the surface S of such covers and extending through the bottom surface B, so as to render such covers capable of functioning as covers for standing, horizontal, vertical or other drainpipes disposed on driveways and other horizontal surfaces such as roads, and even open ground. Such cover designs with or without holes, slots, etc. are also useful for covering circular swimming pool skimmers and other like openings.

Although this disclosure provides particular embodiments of a cover, obvious equivalent modifications and alterations thereof will become apparent to one of ordinary skill in this art after reading this specification and the claims appended hereto. This includes subject matter defined by any combination of any one of the various claims appended hereto (or features or descriptions in the foregoing specification) with any one or more of the remaining claims (or other features or descriptions in the foregoing specification), including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claim(s) so modified. This also includes combination of the features and/or limitations of one or more of the independent claims with features and/or limitations of any other independent claim(s) to arrive at a modified independent claim, with the remaining dependent claims in their original text being read and applied to any independent claim so modified. Accordingly, the presently disclosed invention is intended to cover all such modifications and alterations.

I claim:

1. A cover useful for covering an open end of an access conduit, which comprises:

a) a substantially-circular, disc-shaped base portion having a top surface, a bottom surface, and a circumferential edge, said base portion being dimensioned to cover said open end;

b) a plurality of groups of stability tangs attached to and extending downwardly from said bottom surface of said base portion, said plurality comprising any number of groups of stability tangs between two and twelve, inclusive, wherein each of the groups may comprise any number of individual stability tangs between two and six, inclusive, wherein adjacent groups of stability tangs are disposed separate from one another sufficiently that no portion of any stability tang that is a member of a first selected group of stability tangs is disposed at a distance closer than at least one and one-half times the width of the individual groups of stability tangs present to any portion of any stability tang that is a member of a group of stability tangs adjacent to said first selected group.

2. A cover according to claim 1 wherein said groups of stability tangs are substantially disposed on the same circular path on the bottom surface of said base portion, which circular path has a centerpoint corresponding substantially to the center of the base portion.

3. A cover according to claim 1, wherein said stability tangs are each selectively and easily removable from said base portion, using no more effort than is necessary to remove a conventional knockout provision from a common electrical box.

4. A cover according to claim 1, wherein the distance between individual stability tangs within a given group of stability tangs is any distance in the range of between about one millimeter and 10 millimeters.

5. A cover according to claim 1 wherein the distance between individual stability tangs within a given group of stability tangs is about three millimeters.

6. A cover according to claim 1 wherein the width of an individual stability tang is less than the distance that such stability tang extends from the bottom surface of said base portion.

7. A cover according to claim 1 wherein the width of a group of stability tangs is less than the distance that the stability tangs extend from the bottom surface of said base portion.

8. A cover according to claim 1 wherein the angle theta θ that the longest length dimension that at least one of the stability tangs makes with respect to a line drawn perpendicular to the top surface of the base portion is any angle in the range of from about 10 degrees to about 80 degrees, when said cover is free-standing.

9. A cover according to claim 1 wherein the angle theta θ that the longest length dimension that at least one of the stability tangs makes with respect to a line drawn perpendicular to the top surface of the base portion is any angle in the range of between about zero degrees and about 70 degrees, when said cover is installed in said opening of said access conduit.

10. A cover according to claim 1 wherein the distance of at least one of the stability tangs from the circumferential edge of the base portion is less than about 3 centimeters.

11. A cover according to claim 1 having four groups of stability tangs, wherein each group of stability tangs comprises three stability tangs, and wherein said groups are spaced at 90 degrees from one another along a common circular path on the bottom surface of said base portion.

12. A cover according to claim 1 wherein at least one of said stability tangs has an inner surface which is linear.

13. A cover according to claim 1 wherein at least one of said stability tangs has an inner surface which is curved.

14. A cover according to claim 1 wherein at least one of said stability tangs has an outer surface which has a non-smooth texture.

15. A cover according to claim 14 wherein said non-smooth texture includes a feature selected from the group consisting of: notches, steps, ratchetings, flutings, and knurlings.

16. A cover useful for covering an open end of an access conduit, which comprises:

a) a substantially-circular, disc-shaped base portion having a top surface, a bottom surface, and a circumferential edge, said base portion being dimensioned to cover said open end;

b) a plurality of groups of stability tangs attached to and extending downwardly from said bottom surface of said base portion, said plurality comprising any number of stability tangs between two and twelve, inclusive, wherein said stability tangs are substantially disposed on the same circular path on the bottom surface of said base portion, which circular path has a centerpoint corresponding substantially to the center of the base portion, the distance between individual stability tangs within a given group of stability tangs being any distance between about one millimeter and ten millimeters, and wherein adjacent groups of stability tangs are disposed separate from one another sufficiently that no portion of any stability tang that is a member of a first selected group of stability tangs is disposed at a distance closer than at least one and one-half times the width of the individual groups of stability tangs present to any portion of any stability tang that is a member of a group of stability tangs adjacent to said first selected group, as measured along said same circular path.

17. A cover according to claim 16 wherein the angle theta θ that the longest length dimension that at least one of the stability tangs makes with respect to a line drawn perpendicular to the top surface of the base portion is any angle in the range of from about 10 degrees to about 80 degrees, when said cover is free-standing.

18. A cover according to claim 16 wherein the angle theta 0 that the longest length dimension that at least one of the stability tangs makes with respect to a line drawn perpendicular to the top surface of the base portion is any angle in the range of between about zero degrees and about 70 degrees, when said cover is installed in said opening of said access conduit.

* * * * *